US005582513A

United States Patent [19]

Shigeoka et al.

[11] Patent Number: 5,582,513

[45] Date of Patent: Dec. 10, 1996

[54] SCROLL TYPE FLUID MACHINE HAVING A BIASED DRIVE BUSH

[75] Inventors: Tetsuo Shigeoka, Nagoya; Shigeki Miura, Nishi-Kasugai-gun, both of Japan

[73] Assignee: Mitsubishi Jukogyo Kabushiki Kaisha, Tokyo, Japan

[21] Appl. No.: 450,671

[22] Filed: May 30, 1995

[30] Foreign Application Priority Data

May 31, 1994 [JP] Japan ..... 6-139673

[51] Int. Cl.[6] ..... F01C 1/04; F01C 17/06

[52] U.S. Cl. ..... 418/55.5; 418/57; 418/151

[58] Field of Search ..... 418/55.5, 57, 151

[56] References Cited

U.S. PATENT DOCUMENTS

| | | | |
|---|---|---|---|
| 3,884,599 | 5/1975 | Young et al. | 418/55.5 |
| 3,924,977 | 12/1975 | McCullough | 418/57 |
| 5,040,958 | 8/1991 | Arata et al. | 418/55.5 |
| 5,108,274 | 4/1992 | Kakuda et al. | 418/55.5 |
| 5,328,342 | 7/1994 | Ishii et al. | 418/55.5 |

FOREIGN PATENT DOCUMENTS

| | | | |
|---|---|---|---|
| 2509536 | 9/1976 | Germany . | |
| 4339203 | 5/1994 | Germany . | |
| 55-60684 | 5/1980 | Japan . | |
| 57-49721 | 10/1982 | Japan . | |
| 61-215481 | 9/1986 | Japan | 418/57 |
| 62-13789 | 1/1987 | Japan | 418/57 |
| 62-282186 | 12/1987 | Japan . | |
| 1271681 | 10/1989 | Japan | 418/55.5 |
| 1273890 | 11/1989 | Japan | 418/57 |
| 5-86801 | 4/1993 | Japan . | |
| 2191246 | 12/1987 | United Kingdom . | |

*Primary Examiner*—John J. Vrablik
*Attorney, Agent, or Firm*—Wenderoth, Lind & Ponack

[57] ABSTRACT

In a low speed rotation, side surfaces of a spiral wrap of a swivel scroll are brought into pressing contact with side surfaces of a spiral wrap of a stationary scroll to thereby keep an air tight condition therebetween. When the orbiting swivelling speed of the swivel scroll exceeds the predetermined level, a predetermined gap is kept between the side surfaces of the spiral wrap of the swivel scroll and the side surfaces of the spiral wrap of the stationary scroll to thereby prevent the abnormal wear of the spiral wraps and to thereby suppress an increase of the consumption power. A counterweight is provided on a drive bush for generating a centrifugal force Fc which is greater than a centrifugal force Fs applied to the swivel scroll during the orbiting swivelling motion of the swivel scroll and which is directed in an opposite direction to that of the centrifugal force Fs. A spring member is provided for biasing the drive bush in a direction θ in which the orbiting swivelling radius is increased. Thus, the swivel scroll is shifted in a direction in which the orbiting swivelling radius is decreased when the orbiting swivelling speed exceeds the predetermined level.

11 Claims, 3 Drawing Sheets

SCROLL TYPE FLUID MACHINE HAVING A BIASED DRIVE BUSH

BACKGROUND OF THE INVENTION

The present invention relates to a scroll type fluid machine for use as a compressor, an expander or the like.

A scroll type compressor according to the prior art is shown in FIGS. 3A and 3B.

In FIGS. 3A and 3B, reference numeral 1 denotes a stationary scroll which is composed of an end plate 1*a* and a spiral wrap 1*b* raised from an inner surface of the end plate 1*a*. Reference numeral 2 denotes a swivel scroll which is composed of an end plate 2*a* and a spiral wrap 2*b* raised from an inner surface of the end plate 2*a* in substantially the same shape of that of the above-described spiral wrap 1*b*.

The stationary scroll 1 and swivel scroll 2 are displaced by a predetermined distance r between their centers $O_1$ and $O_2$, and their phase is displaced by 180° to obtain the engagement combination shown, whereby a plurality of compression chambers 3 are defined about the center of the spiral shape with a point symmetry.

A cylindrical boss 4 is projected from an outer central portion of the end plate 2*a* of the swivel scroll 2. A drive bush 5 is rotatably engaged within the boss 4 through a bearing 6. A slide hole 7 is formed in the drive bush 5. An eccentric pin, which eccentrically projects by a predetermined distance r from the axial center $O_1$ of an end face of a rotary shaft 8, is engaged within this slide hole 7.

As shown in FIG. 3B, a cross section of the slide hole 7 is in the form of an oblong shape slanted by an angle θ relative to the eccentric direction of the eccentric pin 9. Linear portions 9*a* formed by cutting both sides of the eccentric pin 9 may slide in contact with and along linear portions 7*a* of the slide hole 7.

When the rotary shaft 8 is rotated, its rotational torque is transmitted to the drive bush 5 through the linear portion 7*a* of the slide hole 7 from the linear portions 9*a* of the eccentric pin 9 and is further transmitted to the swivel scroll 2 through the bearing 6 and the boss 4.

Thus, the swivel scroll 2 is orbited and swivelled on a circular locus having a radius of a predetermined distance r about a center $O_1$ of the axis of the rotary shaft 8 under the condition that the swivel scroll 2 is prevented from rotating about its own axis by a revolving preventing mechanism (not shown).

Then, as gas entrained within the compression chambers 3 is moved toward the center of the spiral shape while reducing their volume, the gas is gradually compressed to reach the central chamber 11 and is discharged through the outlet port 12.

In accordance with the orbiting swivelling motion of the swivel scroll 2, a centrifugal force Fs which is directed in the eccentric direction of the eccentric pin 9 is generated by a weight imbalance caused by the swivel scroll 2, the boss 4, the bearing 6, the drive bush 5 and the like.

On the other hand, a gas force Fp is applied to the swivel scroll by the gas pressure within the compression chambers 3.

The drive bush 5 is moved in the direction of the angle θ by a component F of the centrifugal force Fs and the gas pressure Fp in the direction of the angle θ so that the orbiting and swivelling radius of the swivel scroll 2 is increased, and side surfaces of the spiral wrap 2*b* of the swivel scroll 2 are pressed on side surfaces of the spiral wrap 1*b* of the stationary scroll 1 by the above-described force F.

In the above-described scroll type compressor, there is a fear that when the centrifugal force Fs is increased by the increase of the orbiting swivelling speed of the swivel scroll 2, the force for pressing the side surfaces of the spiral wrap 2*b* of the swivel scroll 2 against the side surfaces of the spiral wrap 1*b* of the stationary scroll 1 would be so excessive that the side surfaces of the spiral wraps 1*b* and 2*b* would be abnormally worn out.

When the orbiting swivelling speed of the swivel scroll exceeds a predetermined level, the swivel scroll is moved in a direction so that the orbiting swivelling radius is decreased. Accordingly, it is possible to suppress the extra contact pressure between the spiral wrap of the swivel scroll and the spiral wrap of the stationary scroll.

SUMMARY OF THE INVENTION

According to the present invention, there is provided a scroll type fluid machine comprising, a stationary scroll and a swivel scroll for orbiting swivelling motion relative to the stationary scroll while being engaged with said stationary scroll with an eccentricity of a predetermined distance relative to the stationary scroll and with an angular displacement. A drive bush is rotatably supported with respect to the swivel scroll. An eccentric pin is eccentric with an axis of a rotary shaft and slidably engages within a slide hole of the drive bush. The drive bush is slidingly moved in a direction perpendicular to an eccentric direction of the eccentric pin to thereby change an orbiting swivelling radius of the swivel scroll; a counterweight is provided with the drive bush for generating a centrifugal force Fc greater than a centrifugal force Fs applied to the drive bush during the orbiting swivelling motion of the swivel scroll and in a direction opposite to that of the centrifugal force Fs, and a spring member is provided for biasing the drive bush in a direction in which the orbiting swivelling radius is increased in the slide direction, whereby when the orbiting swivelling speed exceeds a predetermined level, the swivel scroll is shifted in a direction in which the orbiting swivelling radius is decreased.

A displacement limiting means for limiting a displacement in the direction in which the orbiting swivelling radius is decreased is provided with the drive bush.

The displacement limiting means comprises stepped shouldered portions formed in the slide hole. The spring member is composed of a coil spring. The coil spring is interposed at a stepped groove provided at one end of the slide hole and said eccentric pin.

DESCRIPTION OF THE PREFERRED EMBODIMENTS

Figure 1A:
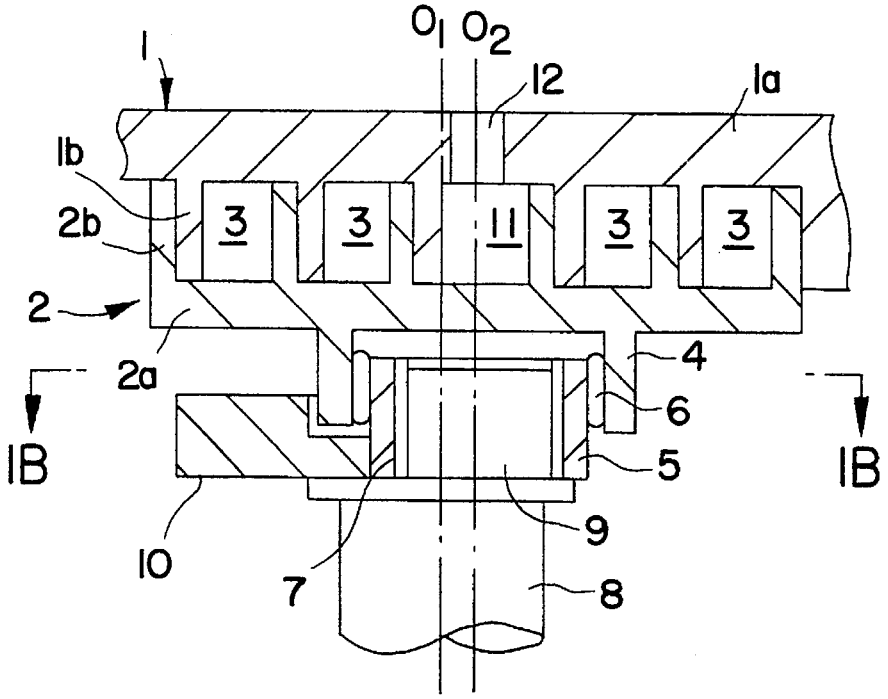
FIGS. 1A and 1B show one embodiment of the invention, FIG. 1A being a longitudinal sectional view of a primary part and FIG. 1B being a cross-sectional view taken along the line 1B–1B of FIG. 1A.

The present invention will now be described by way of example with reference to FIGS. 1A and 1B.

A counterweight 10 is mounted on a drive bush 5. The counterweight 10 is moved in an opposite direction to that of a centrifugal force Fs to be applied to a swivel scroll upon the orbiting swivelling motion of the swivel scroll 2 and generates a centrifugal force Fc that is greater than the centrifugal force Fs.

Figure 1B:
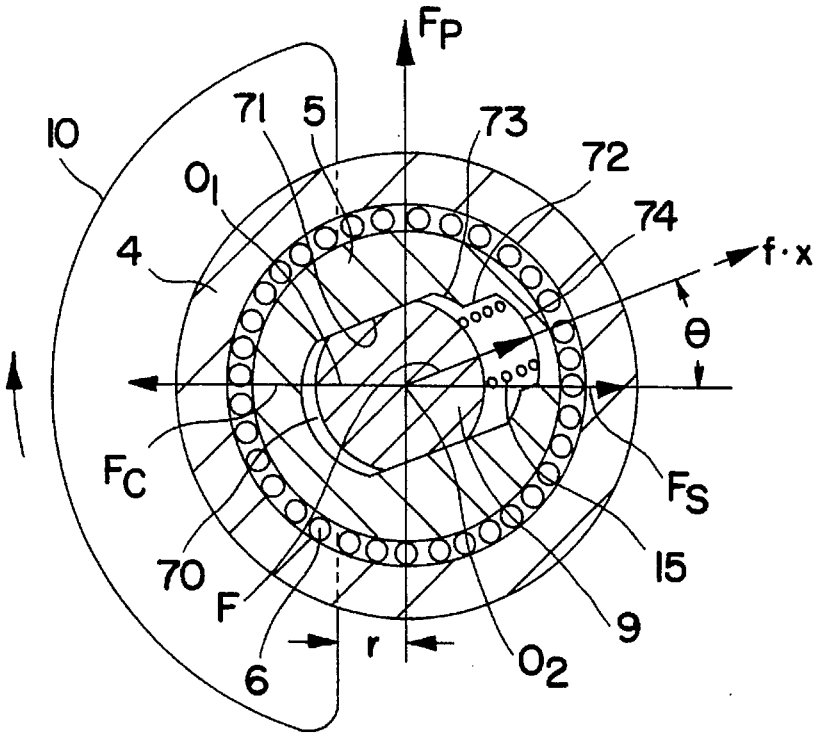

As shown in FIG. 1B, a slide hole 70 of the drive bush 5 is composed of a large width portion 71 and a stepped groove 72. Shoulder portions are formed at a boundary therebetween.

An eccentric pin 9 is slidably engaged with the large width portion 71, and a spring member 15 made of a coil spring is received in the stepped groove 72.

One end of the spring member 15 is brought into contact with the eccentric pin 9. The other end thereof is brought into contact with a bottom 74 of the stepped groove 72 to bias the drive bush 5 in a slide direction, i.e., a direction where the orbiting swivelling radius is increased in the direction of the angle θ.

Thus, when the orbiting swivelling speed of the swivel scroll 2 is less than a predetermined level, the drive bush is moved in the direction in which the orbiting swivelling radius is increased. On the other hand, when the orbiting swivelling speed of the swivel scroll 2 is greater than the predetermined level, the drive bush is moved in the direction in which the orbiting swivelling radius is decreased.

Figure 3A:
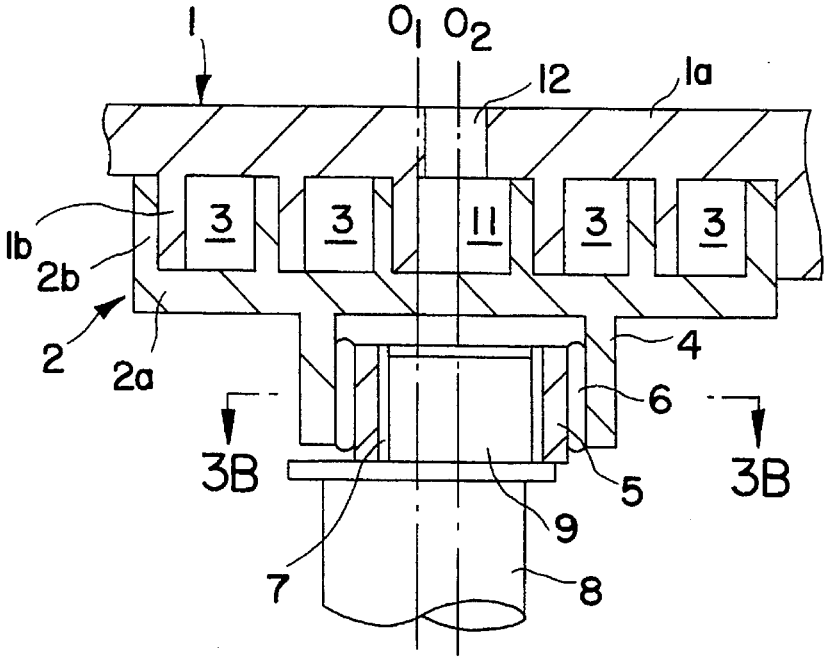
FIG. 3(A) (PRIOR ART)
FIGS. 3A and 3B show one example of a conventional scroll type compressor, FIG. 3A being a longitudinal sectional view of a primary part and FIG. 3B being a cross-sectional view taken along the line 3B–3B of FIG. 3A.
Figure 3B:
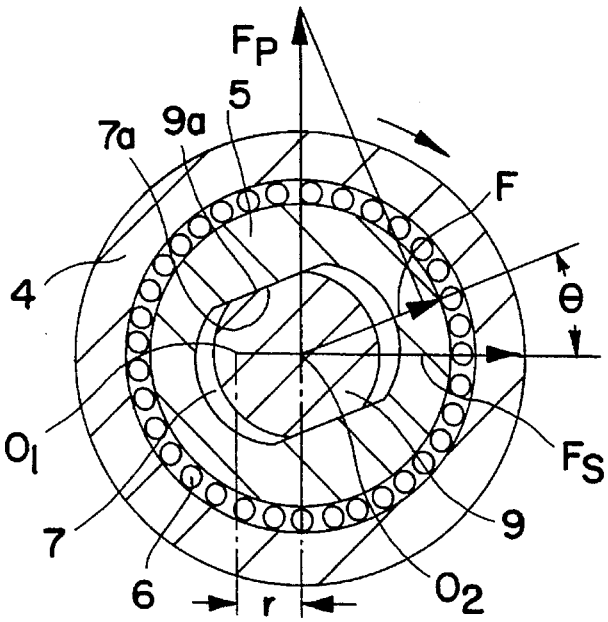
FIG. 3(B) (PRIOR ART)

The other structure is the same as that of the conventional technology shown in FIGS. 3A and 3B, and the same reference numerals are used to designate the like components and members.

Figure 2:
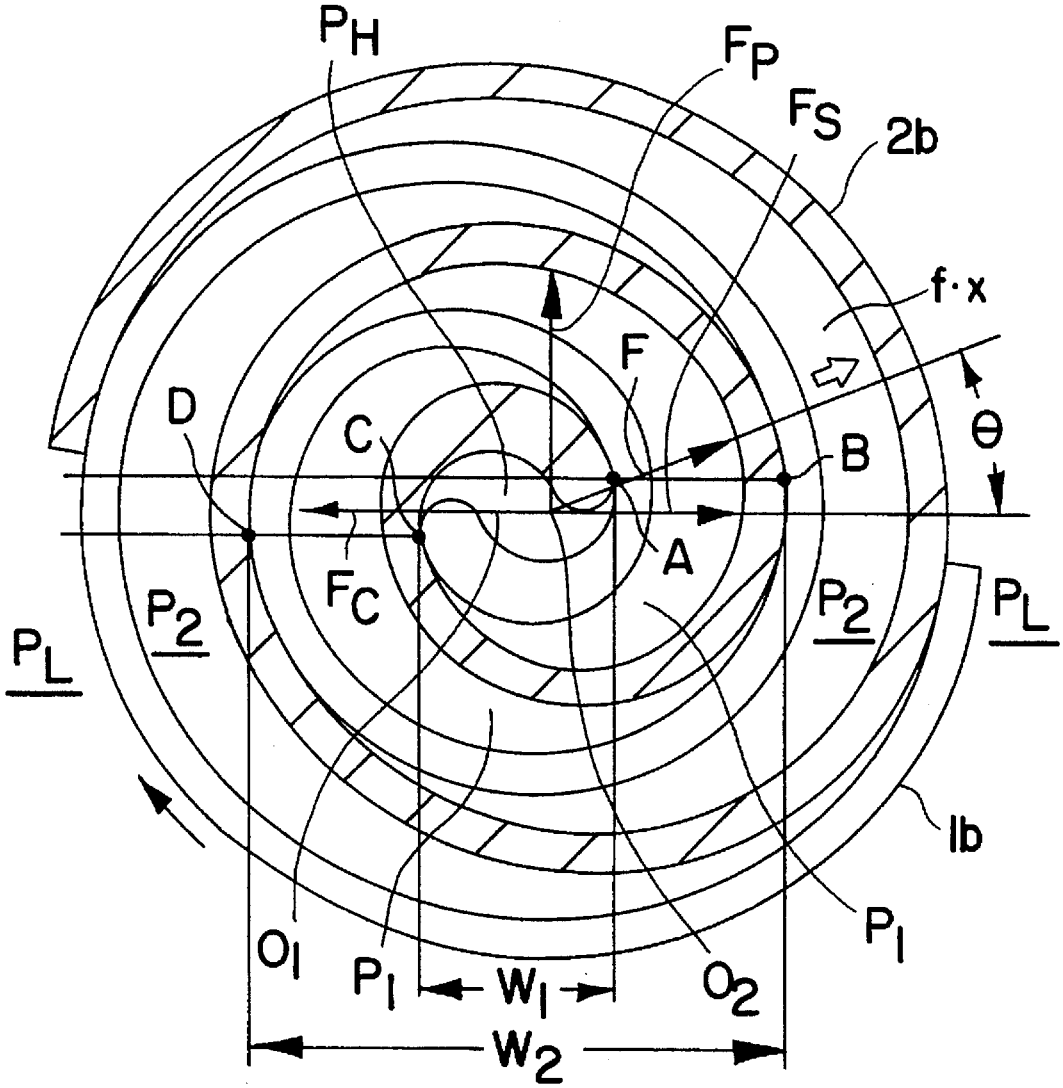
FIG. 2 is an illustration of forces applied to the swivel scroll in the embodiment.

A force which is applied to the swivel scroll 2 during the operation of the compressor will be explained with reference to FIG. 2.

The force Fp which is directed to a direction perpendicular to the eccentric direction of the gas force based upon the gas pressure within each compression chamber 3 is given in equation 1:

$$Fp=(P_H-P_L)\cdot h\cdot W_1+(P_1-P_2)\cdot h\cdot W_2$$

where $P_H$ is the exhaust pressure, $P_L$ is the suction pressure, $P_1$ is the gas pressure within an inner compression chamber 3, $P_2$ is the gas pressure within an outer compression chamber 3, h is the height of the spiral wraps 1*b* and 2*b*, $W_1$ is the distance between contact points A and C of the spiral wraps 1*b* and 2*b*, and $W_2$ is the distance between contact points B and D of the spiral wraps 1*b* and 2*b*.

Incidentally, although a force which is directed perpendicular to the force Fp is generated, this is very small and hence is negligible.

On the other hand, the centrifugal force Fs, which is directed in the eccentric direction, is applied to the center $O_2$ of the swivel scroll 2, and the centrifugal force Fc is applied in the opposite direction to the centrifugal force Fs.

Thus, if a force to the drive bush 5 in a right upward direction along the slide direction θ is given by F, the force F is given by equation 2:

$$F=Fs\cos\theta+Fp\sin\theta-Fc\cos\theta+f\cdot x$$

where f·x is the force by the spring member 15, f is the elastic coefficient of the spring member 15 and x is the displacement of the spring member 15.

Therefore, when the orbiting swivelling speed of the swivel scroll 2 is less than a predetermined level, the force F is positive, and when the speed is greater than the predetermined level, the factors Fs, Fc, Fp, f·x and the angle θ are selected so that the force is negative. More specifically, spring coefficient f of the spring member 15 is selected.

Thus, when the orbiting swivelling speed of the swivel scroll 2 is less than the predetermined level, the side surfaces of the spiral wrap 2*b* are pressed against the side surfaces of the spiral wrap 1*b* of the stationary scroll 1 by the force F. As a result, the drive bush 5 is slidingly moved in the right upward direction along the direction θ within the large width portion 72 of the slide hole 70. Thus, the orbiting swivelling radius is increased, and the spring member 15 is elongated.

When the orbiting swivelling speed of the swivel scroll 2 is greater than the predetermined level, the side surfaces of the spiral wrap 2*b* are separated away from the spiral wrap 1*b* of the stationary scroll 1 by the force F. Thus, the orbiting swivelling radius is decreased and the spring member 15 is shortened.

In response to the increase of the orbiting swivelling speed of the swivel scroll 2, the drive bush 5 is moved in a left downward direction in the direction of the angle θ. However, when the eccentric pin 9 is brought into contact with the stepped shoulder portions 73 of the slide hole 70, the eccentric pin 9 is not moved beyond the shoulder portions 73. Thus, the operation continues while maintaining a predetermined distance between the spiral wraps 1*b* and 2*b*.

According to the present invention, the counterweight is provided to the drive bush for generating a larger centrifugal force Fc than the centrifugal force Fs in the opposite direction to the centrifugal force Fs applied to the swivel scroll during the orbiting and swivelling motion of the swivel scroll, and the spring member is provided for biasing the drive bush in the direction the orbiting swivelling radius is increased in the slide direction, whereby when the orbiting swivelling speed of the swivel scroll exceeds the predetermined level, the swivel scroll is moved in a direction that the orbiting swivelling radius is decreased. Accordingly, it is possible to suppress the extra contact pressure between the spiral wrap of the swivel scroll and the spiral wrap of the stationary scroll.

Also, in low speed rotation, the side surfaces of the spiral wrap of the swivel scroll are brought into pressing contact with the side surfaces of the spiral wrap of the stationary scroll to thereby keep an air tight condition therebetween.

However, in the case where the orbiting swivelling speed of the swivel scroll exceeds the predetermined level, a predetermined gap is kept between the side surfaces of the spiral wrap of the swivel scroll and the side surfaces of the spiral wrap of the stationary scroll to thereby prevent abnormal wear of the spiral wraps and to thereby suppress the increase of the consumption power.

What we claim is:

1. A scroll fluid machine arrangement, comprising:

a stationary scroll;

a swivel scroll engaged with said stationary scroll for orbital movement relative to said swivel scroll, said swivel scroll having an eccentricity of a predetermined distance relative to said stationary scroll and having an angular displacement relative to said stationary scroll;

a drive bush that is rotatably engaged with said swivel scroll, said drive bush having a slide hole therein;

a rotary shaft having an axis and an eccentric pin thereon that is eccentric with respect to the axis in a direction of eccentricity, said eccentric pin being engaged with said slide hole of said drive bush such that said eccentric pin is slidable in said slide hole in a direction at an angle to the direction of eccentricity, whereby an orbiting swiveling radius of said swivel scroll can change, and whereby orbital movement of said swivel scroll due to rotation of said rotary shaft causes a centrifugal force Fs to be applied to said drive bush due to the weight of said swivel scroll tending to increase the orbiting swiveling radius;

means mounted with said drive bush for generating a centrifugal force Fc greater than the centrifugal force Fs and in an opposite direction to the direction of the centrifugal force Fs, tending to decrease the orbiting swiveling radius, said means comprising a counterweight; and means for biasing said drive bush in the direction at an angle to the direction of eccentricity in which said slide pin is slidable in said slide hole of said drive bush and in a direction tending to increase the orbiting swiveling radius of said swivel scroll such that when the orbital speed of said swivel scroll exceeds a predetermined level, said swivel scroll is shifted in a direction in which the orbiting radius is decreased, said means for biasing comprising a spring member.

2. The scroll fluid machine arrangement of claim 1, wherein said drive bush further comprises a displacement limiting means for limiting the displacement of said drive bush in the direction in which the orbiting radius is decreased.

3. The scroll fluid machine arrangement of claim 2, wherein said displacement limiting means comprises stepped shoulder portions formed in said slide hole for engaging said slide pin.

4. The scroll fluid machine arrangement of claim 3, wherein said spring member comprises a coil spring in compression disposed between said stepped shoulder portions and between said drive bush and said slide pin in said slide hole.

5. The scroll fluid machine arrangement of claim 3, wherein said slide hole has straight surfaces engaging with straight surfaces of said slide pin so as to prevent relative rotation therebetween while allowing sliding movement therebetween.

6. The scroll fluid machine arrangement of claim 1, wherein said spring member comprises a coil spring.

7. The scroll fluid machine arrangement of claim 6, wherein said slide hole comprises a stepped groove at one end of said slide hole and said coil spring is disposed in said stepped groove between said slide hole and said drive bush.

8. The scroll fluid machine arrangement of claim 1, wherein said counterweight is fixed relative to said drive bush.

9. The scroll fluid machine arrangement of claim 1, wherein said means mounted with said drive bush, said means for biasing and said swivel scroll operate, upon rotation of said rotary shaft and orbital movement of said swivel scroll, to bias said drive bush toward one end of said slide hole so as to increase the orbital swiveling radius in a first range of speed of rotation of said rotary shaft wherein the force due to said spring member is greater than the difference between the centrifugal force Fc and the centrifugal force Fs, and in a second range of speed of rotation, where the orbital speed exceeds the predetermined level and the difference between the centrifugal force Fc and the centrifugal force Fs is greater than the force of said spring member, to decrease the orbital swiveling radius.

10. The scroll fluid machine arrangement of claim 9, and further comprising means for limiting the decrease of the orbital swiveling radius in the second range of speed of rotation.

11. The scroll fluid machine arrangement of claim 10, wherein said means for limiting comprises stepped shoulder portions formed in said slide hole for engaging said slide pin.

* * * * *